US005273155A

United States Patent [19]

Sala

[11] Patent Number: 5,273,155

[45] Date of Patent: Dec. 28, 1993

[54] SUPPORT FOR DESKTOP CALENDARS

[75] Inventor: André R. Sala, Barcelona, Spain

[73] Assignee: Vilagrasa, S.A., Barcelona, Spain

[21] Appl. No.: 963,713

[22] Filed: Oct. 20, 1992

[30] Foreign Application Priority Data

Oct. 29, 1991 [ES] Spain ..... 9103225[U]

[51] Int. Cl.[5] ..... B65D 79/00

[52] U.S. Cl. ..... 206/45.13; 206/45.15; 281/44; 40/107

[58] Field of Search ..... 206/44 B, 45.14, 45.15, 206/45.17, 214, 45.13; 281/44; 40/107, 113, 114, 358

[56] References Cited

U.S. PATENT DOCUMENTS 892,850 7/1908 Keplinger ..... 206/45.15
1,810,951 6/1931 Eisenberg ..... 281/44
2,079,257 5/1937 Kaiser ..... 281/44
2,789,836 4/1957 Jeannin ..... 206/45.15
2,930,160 3/1960 Pohl ..... 206/45.13

FOREIGN PATENT DOCUMENTS 9003454 5/1990 Fed. Rep. of Germany .
1316034 12/1962 France .
1424648 12/1965 France .
2377170 9/1978 France ..... 206/44 B

*Primary Examiner*—David T. Fidei
*Attorney, Agent, or Firm*—Abelman Frayne & Schwab

[57] ABSTRACT

A support for a block-type desk calendar has a base, and elongate rings in which the calendar is secured, and has covers that fold over the base to completely enclose the calendar, the covers having cut outs for accommodating the elongate rings, the covers providing for the support of a single leaf of the calendar when the covers are in a closed position.

4 Claims, 3 Drawing Sheets

SUPPORT FOR DESKTOP CALENDARS

FIELD OF THE INVENTION

This invention relates to a support for desktop or block-type calendars.

BACKGROUND OF THE INVENTION

Block-type calendars are widely used which display the day and other calendar information on the current page, and which provide space for the writing of notes.

SUMMARY OF THE INVENTION

The present invention provides a support for a desktop calendar which can be closed completely when the calendar is not in use, thereby protecting the calendar block from damage and making it considerably more easy to clean the desk on which the calendar is placed. The support provides a surface for supporting the current page of the calendar, which can thus be written upon more easily.

The support of the present invention comprises a body, preferably molded out of a plastics material, which consists of a flat rectangular lower base, side members which extend perpendicularly from the base along the longer edges thereof, and, a transverse straight partition dividing the resulting structure into two receptacles or housings in which the block-type calendar is received, the calendar being secured in position by elongate rings in the At each of the ends of the side members are pivots for covers which can be closed to fit into each of the two parts into which the body is divided. The covers have cut-outs on their free edges which can fit around the elongate rings without interfering with the rings in any way. One of the covers acts as a writing support for the current page of the calendar.

BRIEF DESCRIPTION OF THE DRAWINGS

An illustrative but non-limiting example of desktop calendar according to the present invention is shown in the accompanying drawings, in which.

DESCRIPTION OF THE PREFERRED EMBODIMENTS

Figure 1:
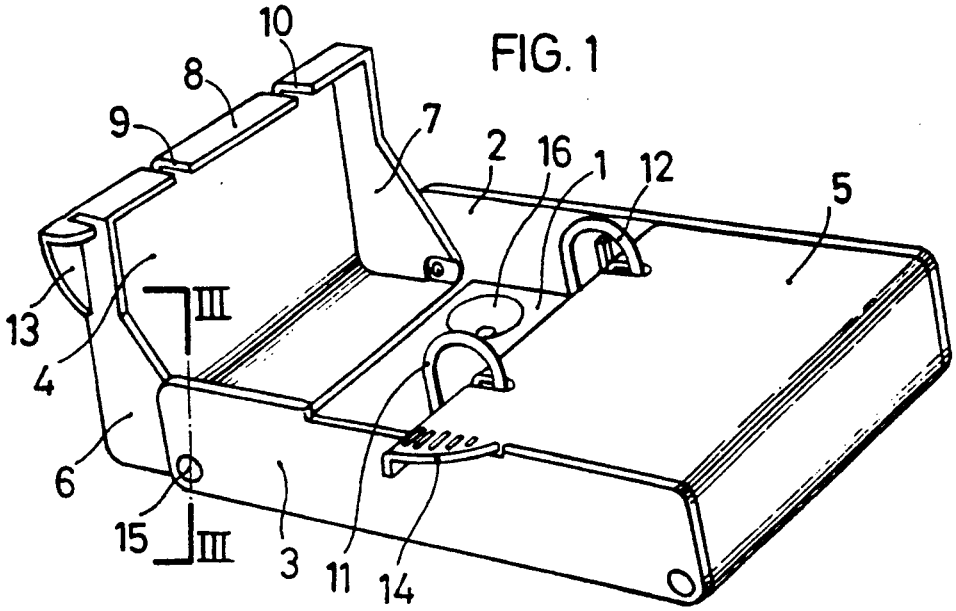
FIG. 1 is a perspective view of a calendar support according to the present invention.

The support of the present invention consists of a molded body which has a plain rectangular lower base 1, along the longer opposite sides of which extend straight side members 2 and 3, which extend perpendicular to said base The ends of the side wall extend beyond the opposite ends of the base 1 and are fitted covers 4 and 5 which pivot about the side members 2 and 3. The covers each have lateral strengthening wings 6 and 7 as well as a rightangled tongue 8 on their free edge, the tongue 8 having cutouts 9 and 10 to accommodate conventional rings 11 and 12.

The covers 4 and 5 each have curved extensions 13 and 14 adjacent the tongues 8 for use in raising the respective covers 4 and 5.

Figure 2:
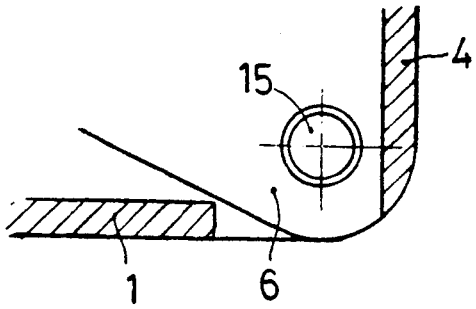
FIG. 2 is a detail in cross-section of a pivot of one of the covers.
Figure 3:
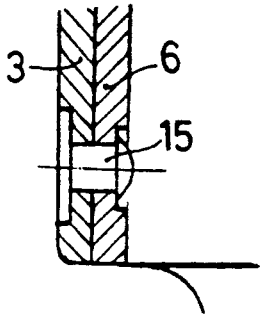
FIG. 3 is a cross-section taken on the line III—III in FIG. 1.
Figure 4:
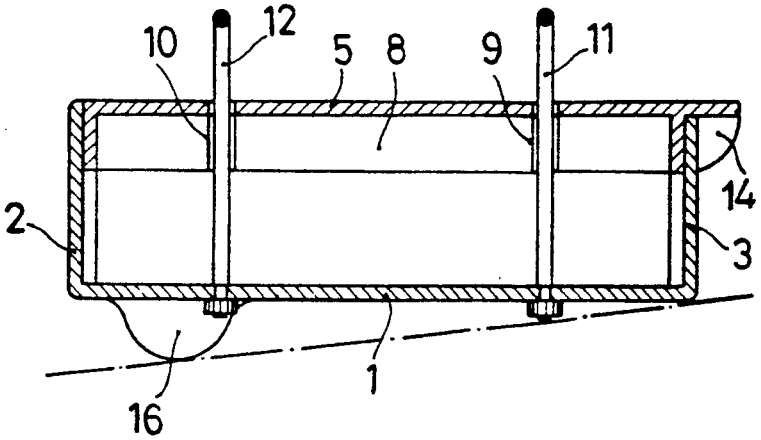
FIG. 4 is a transverse cross-section of the support.
Figure 5:
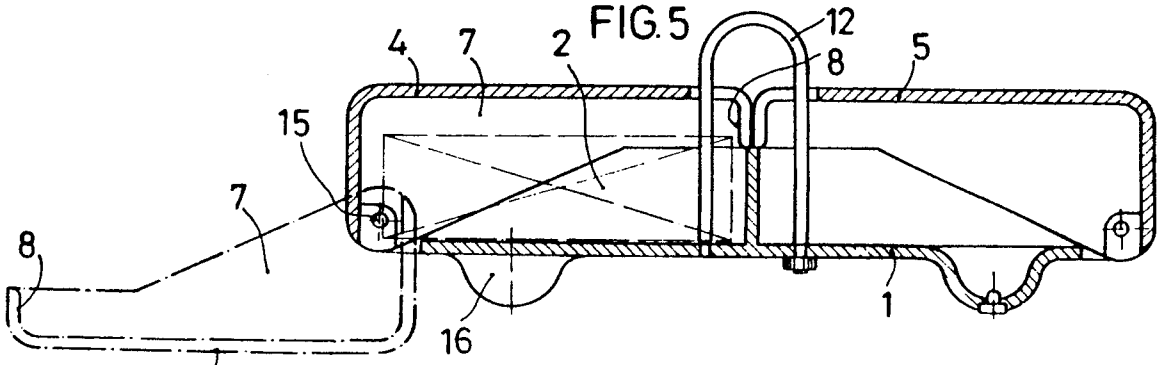
FIG. 5 shows a longitudinal cross-section of the support.
Figure 6:
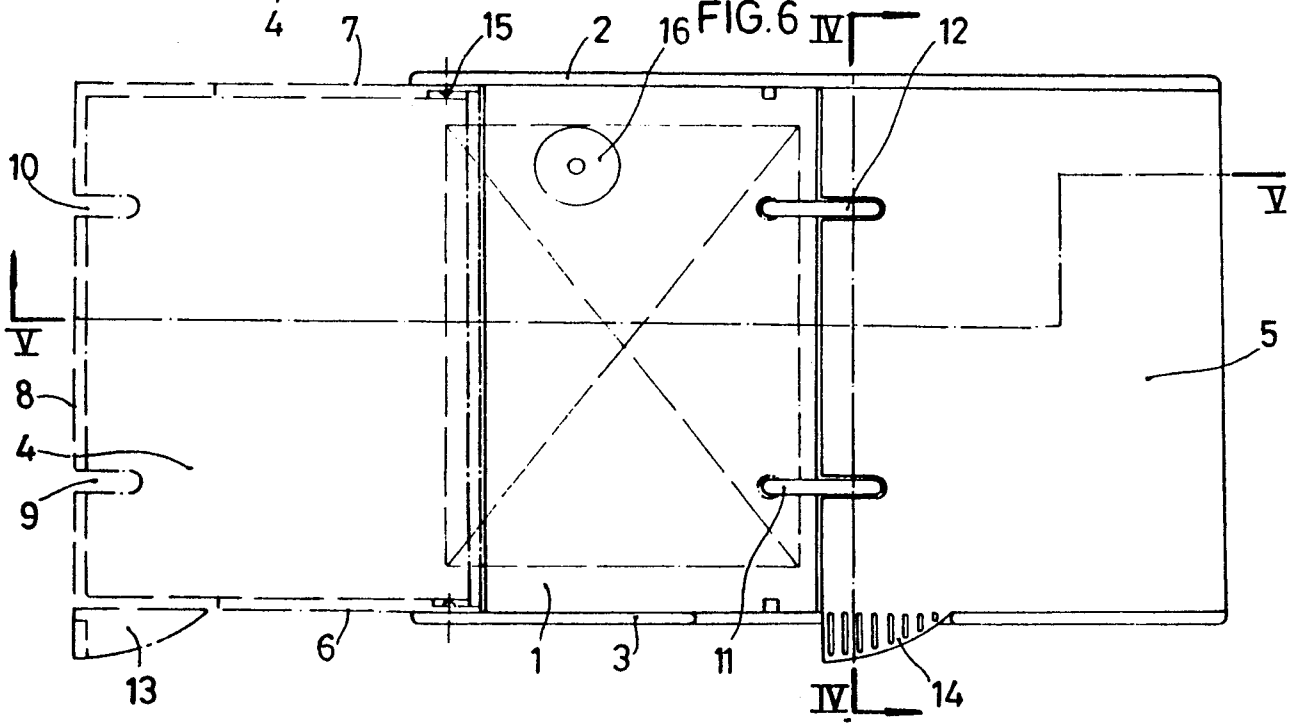
FIG. 6 is a plan view corresponding to FIG. 5.

The covers 4 and 5 pivot about the side members 2 and 3, as is shown in detail in FIGS. 2 and 3, by means of transverse rivets 15.

The covers 4 or 5 act as support for the current page of the calendar, which will therefore always be at the same height, thereby greatly improving its visibility and the process of writing thereon.

The lower face 1 of the support has protuberances 16 close to its rear edge, in order to incline the support slightly when it is placed on a table or similar surface.

Figure 7:
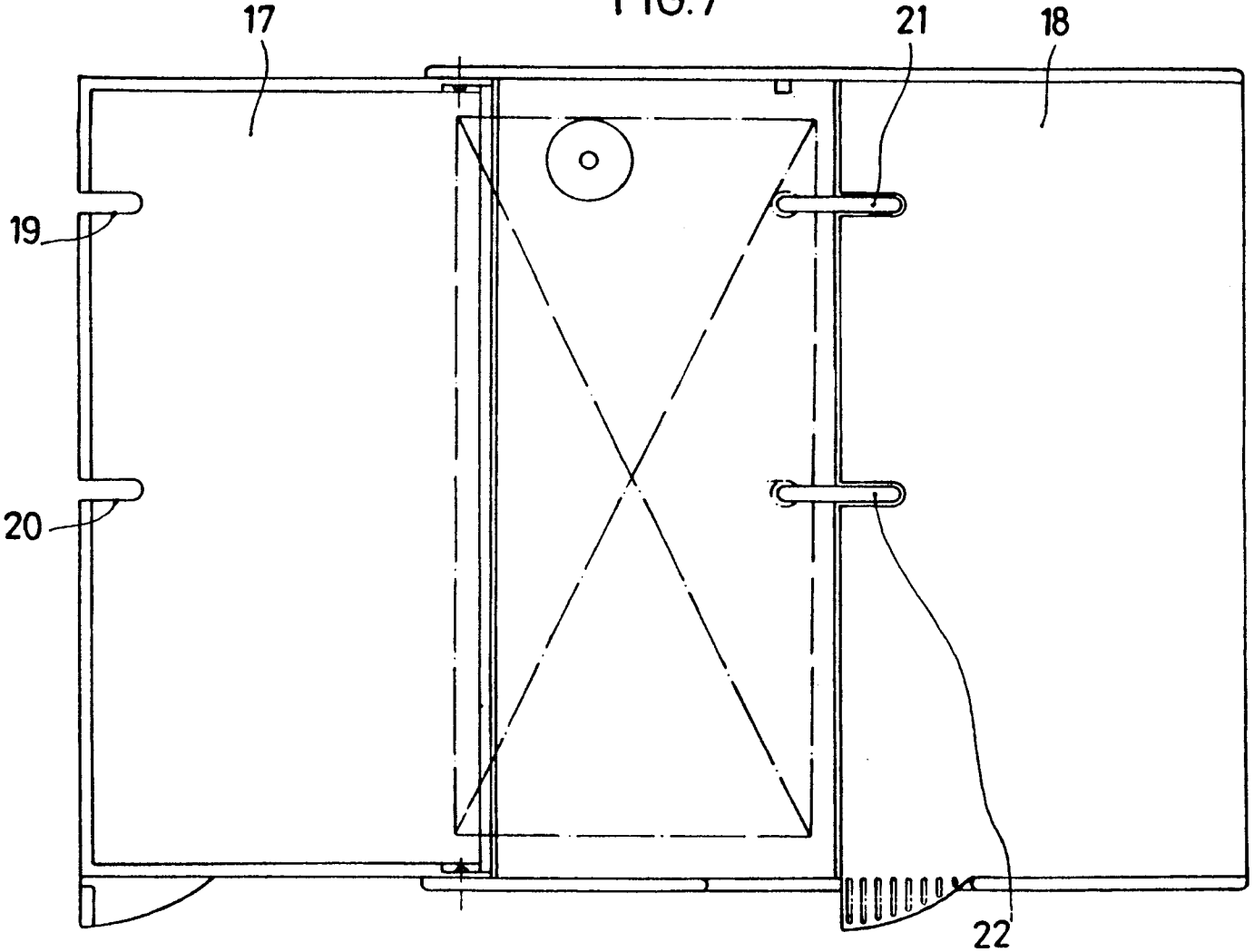
FIG. 7 is a plan view of a calendar support in another embodiment designed for extra long pages.

The present invention may take the form of the preferred embodiment shown in FIG. 7, in which the covers 17 and 18 are greater in length relative to a standard or normal calendar, such that the support can be used for holding extra-long calendar pages. In this case the cutouts 19 and 20 for the corresponding rings 21 and 22 are not symmetrically arranged but are decentralized towards one of the ends of said covers to accommodate the extra-long calendar pages.

Any further details which does not affect, alter, change or modify the basic principle of the support described above falls within the scope of the appended claims.

I claim:

1. A support for a desktop calendar of the block-type, including:

a rectangular planar base;

sidewalls of said base extending perpendicular to said base alone a pair of opposite edges of said base;

covers pivotally secured to said sidewalls at each end of said sidewalls, said covers being movable between a first position in which said calendar is exposed to view, and a second position in which said calendar is enclosed by said covers;

elongate rings attached to aid planar base for securing said calendar to said base;

a free edge of each cover having a tongue extending at right angles to a major surface of said each cover; and, cut-outs extending through each tongue and an adjacent portion of the associated said each cover, said cut-outs being for the reception of said elongate rings when said covers are in said second position.

2. The support of claim 1, further including a transversely extending partition positioned intermediate said elongate rings.

3. The support of claim 1, further including protuberances on a rear face of said base, for supporting said base in an inclined position.

4. The support of claim 1, further including an extension on said each cover extending laterally of a said side edge permitting raising of said cover when in said second position.

* * * * *

UNITED STATES PATENT AND TRADEMARK OFFICE

CERTIFICATE OF CORRECTION

PATENT NO. : 5,273,155

DATED : December 28, 1993

INVENTOR(S) : André Ricard Sala

It is certified that error appears in the above-indentified patent and that said Letters Patent is hereby corrected as shown below:

On the title page, item [75] Inventor:
For "André R. Sala" substitute -- André RICARD SALA --.

Signed and Sealed this

Twenty-sixth Day of April, 1994

*Attest:*

*Attesting Officer*

Bruce Lehman

BRUCE LEHMAN

*Commissioner of Patents and Trademarks*